US005198057A

United States Patent [19]

Newkirk et al.

[11] Patent Number: 5,198,057

[45] Date of Patent: Mar. 30, 1993

[54] REBULKABLE NONWOVEN FABRIC

[75] Inventors: David D. Newkirk, Greer; Henry S. Ostrowski, Simpsonville, both of S.C.

[73] Assignee: Fiberweb North America, Inc., Simpsonville, S.C.

[21] Appl. No.: 896,321

[22] Filed: Jun. 10, 1992

Related U.S. Application Data

[62] Division of Ser. No. 288,834, Dec. 23, 1988, Pat. No. 5,143,779.

[51] Int. Cl.[5] ..... B32B 31/20; B32B 31/26; B32B 35/00; D04H 1/54

[52] U.S. Cl. ..... 156/83; 53/430; 156/281; 156/308.2; 242/55.1

[58] Field of Search ..... 156/308.2, 83, 281; 53/430; 242/55.1

[56] References Cited

U.S. PATENT DOCUMENTS 3,669,788 6/1972 Allman et al. ..... 156/167
4,068,036 1/1978 Stanistreet ..... 428/296
4,548,856 10/1985 Ali Khan et al. ..... 428/171
4,601,937 7/1986 Lathasek ..... 428/132
5,143,779 9/1992 Newkirk et al. ..... 428/218

FOREIGN PATENT DOCUMENTS 1334735 10/1973 United Kingdom .

OTHER PUBLICATIONS

Pirkkanen, *Nonwovens World*, Nov. 1987, pp. 56-57.

*Primary Examiner*—James C. Cannon
*Attorney, Agent, or Firm*—Bell, Seltzer, Park & Gibson

[57] ABSTRACT

Disclosed is a process for making bulky nonwoven fabric suitable for use in diaper constructions that comprises the steps of (a) forming a web of one or more layers comprised at least in part of thermoplastic bicomponent fibers, (b) bonding said web by means of a thru-air system, (c) compressing—either in a nip or by winding—the resulting bonded web to increase its density, (d) transporting and/or otherwise manipulating the compressed web, and (e) subsequently transforming said compressed web, by means of exposure to heat, into the low density bulky nonwoven fabric. The bulky nonwoven fabrics are particularly useful as diaper coverstock and as diaper spacer fabrics.

12 Claims, No Drawings

REBULKABLE NONWOVEN FABRIC

This application is a divisional of application Ser. No. 07/288,834, filed Dec. 23, 1988, now U.S. Pat. No. 5,143,779.

BACKGROUND OF THE INVENTION

This invention relates to nonwoven fabrics. More particularly, the present invention relates to nonwoven fabrics composed of thermoplastic resin fibers and to methods for manufacturing such fabrics. The nonwoven fabrics of the present invention are configured in such a way as to be useful in constructing absorbent products such as disposable diapers, adult incontinence pads, and sanitary napkins. The nonwoven fabrics of our invention are especially useful as coverstock and as spacer fabrics in absorbent personal care products.

Disposable diapers, sanitary napkins, and the like are generally composed of an impermeable outer covering, an absorbent layer, and an inner layer that—ideally—permits liquid to flow through it rapidly into the absorbent layer ("rapid strike through") but does not permit or at least does not facilitate re-transmission of liquid from the absorbent layer to the baby or wearer side of said inner layer ("resists rewet"). Said inner layer is referred to as coverstock, topsheet, or, in diaper applications, diaper liner. In addition to liquid transport properties, the coverstock must have sufficient strength to allow for converting it—that is, incorporating into the final product—on a diaper or other machine and for resistance to failure during vigorous movement by the user. On the other hand, while strength is essential, the coverstock should present a soft comfortable feel against the user's skin. The subjective feel—softness and dryness—of diaper liner has become more important with the increased use of diapers by incontinent adults. Currently these somewhat conflicting requirements—for softness coupled with strength—have been met only imperfectly, for the most part by coverstock made from thin low basis weight carded or spunbonded nonwoven fabrics.

Recently some absorbent products have been constructed with a "spacer" layer between the absorbent layer and the thin coverstock layer. The spacer layer can provide several functions including fluid acquisition, distribution including lateral liquid transport or "wicking", and separation. Body fluid is often discharged in gushes. The spacer layer must quickly acquire the flood of liquid and transport it by wicking from the point of initial introduction to many parts of the absorbent layer. Distribution and wicking have become of greater importance with the use of expensive superabsorbent polymers (SAP) as part of the absorbent layer. Full utilization of the absorbent material insures economic use of the SAP and prevents gel blocking. The liquid transport aspects of a spacer or fluid acquisition/distribution layer is described more fully in U.S. Pat. No. 4,673,402 . The spacer layer can also improve diaper dryness by increasing the distance or separation between the thin topsheet and the wet absorbent core. A bulky, porous, compression-resistant nonwoven fabric can be used as the spacer layer to yield superior softness, liquid distribution, and surface dryness.

Many of the advantages promised by use of a spacer layer can be achieved using a conventional diaper design if the thickness or caliper of that diaper coverstock fabric is increased. It has been recognized that many aspects of coverstock performance could be substantially improved if the thickness, or caliper, of the coverstock fabric were increased. Surface dryness can be improved by increasing the separation between the wearer's skin and the absorbent core of the diaper. A thick bulky diaper liner could also provide many of the liquid acquisition, distribution, and wicking functions expected from a spacer layer. Since these functions must be maintained during use of the diaper, it is essential that the thick diaper liner maintain its caliper under some degree of compression loading. Thickness can be increased by increasing the basis weight of the coverstock and/or by decreasing the density thereof (that is, by making the coverstock more lofty). Increased thickness through loft should offer improved softness as well as improved surface dryness.

Many approaches have been suggested for producing thick diaper liner. For example, U.S. Pat. No. 4,041,951 teaches embossing nonwoven topsheet to increase its bulk, and U.S. Pat. No. 4,391,869 discloses limiting the amount of aqueous binder applied in the suction bonding of airlaid nonwoven fabric. More recently, the use of thru-air bonded bicomponent fiber structures have been investigated. One use of the thru-air technique is alluded to in an article entitled "Multi-layer Nonwovens for Coverstock, Medical, and other End Uses" by J. Pirkanen in the November 1987 issue of "Nonwovens World". The reference discloses a multilayer nonwoven fabric having a basis weight of about 30 grams per square meter. U.S. Pat. No. 4,548,856 and U.K. Patent Application GB 2,127,865A disclose thru-air bonding procedures that involve the use of multibelt systems to form patterned nonwoven fabrics.

U.S. Pat. No. 4,652,484 assigned to Kao teaches that improved diaper liner will result from a layered structure wherein the first layer is predominently comprised of 1-3 denier "straight" bicomponent fibers and the second layer is predominently comprised of sterically buckled (three-dimensional crimp) 1.5 to 6 denier bicomponent fibers.

Copending U.S. patent application Ser. No. 07/184,228 discloses diaper liner having properties of thickness, softness, and strength comparable to the Kao products that can be manufactured using flat-crimped (rather than sterically-buckled) bicomponent fibers and that achieves such results at substantially reduced basis weights compared to the basis weights of comparable webs described by the Kao patent.

A major practical problem with high loft nonwoven fabrics used for diaper applications such as coverstock or spacer fabrics is that very large diameter soft rolls are generated upon winding relatively short linear yardage thereof. This tends to make shipping more expensive. The soft roll can easily be damaged. Diaper machine efficiency is compromised since short roll lengths require frequent roll changes during the conversion process.

A solution to the problem of large diameter rolls is to make a condensed nonwoven web that can be bulked into a lofty web just before or during diaper manufacture. This approach is well known in the art of powder bond structures. Powder bonding, however, requires the need for expensive infrared oven systems, powder applicators, and costly polyester powder adhesives. It is difficult, if not impossible, to achieve the superior balance of caliper and softness using bulked powder bond structures that can be obtained with lofty thru-air bonded bicomponent fabrics. The present invention, which provides methods to form compressed webs that can be transformed into soft lofty webs with properties that approach those of a never-compressed bicomponent thru-air bonded structure, is a major advance in the art.

U.S. Pat. No. 4,601,937, assigned to Akzona Incorporated, teaches a way to reversibly densify nonwoven webs consisting of the steps of first heating while under compression followed by cooling under compression. The resulting densified web can then be transformed to a lofty low density web by heating without compression. During the first heating step, a temperature below that which changes the state of fiber aggregation is specified. The examples and the description of the invention suggest that the Akzona disclosure is concerned only with nonwoven fabrics used in clothing and industrial application and having basis weights of 80 g/m$^2$ through 200 g/m$^2$.

U.S. Pat. Nos. 3,911,641; 3,927,504; 3,964,232; 3,991,538; and 4,163,353 describe methods for packaging very flexible compressible materials such as are used for building insulation.

U.S. Pat. No. 3,669,788 teaches an approach for making bulky acetate fiber nonwoven webs by the steps of extruding a solution of cellulose acetate to form continuous filaments, agitating the filaments while they are in a mutually adhesive state so they become randomly bonded, collecting the filaments in a flat bonded sheet, and then contacting the sheet with steam at temperature of 95°-180° C. such that the web becomes bulky with a significant increase in loft and softness. The description in this patent is limited to webs made using organic acid esters of cellulose such as cellulose acetate.

British Patent 1,334,735 teaches a method for making bulky products by first adhesively bonding a plurality of spaced filaments of a heat shrinkable fiber to a base nonwoven web and then subjecting the resulting product to sufficient heat to shrink the filaments (i.e. contract them in a longitudinal direction), thus causing the fabric itself to shrink with consequent increase in bulk. The description in this patent is limited to a layered structure wherein the two layers are made of fibers having significantly different heat histories.

We have now discovered two approaches to forming a compressed web that can then be transformed into a lofty web with properties nearly matching those of never-compressed bicomponent thru-air bonded fabrics.

In the first approach a bicomponent-fiber based thru-air bonded web is compressed in a nip, preferably as it exits the thru-air bonding oven. A roll of compressed web thus results. It has now been discovered that re-exposure of this compressed web to the proper choice of temperature will regenerate a lofty web with many properties similar to those seen in the initial thru-air bonded never-compressed web.

In the second approach, a bicomponent-fiber-based thru-air bonded product is formed as a lofty web but is then wound under sufficient tension to compress the lofty structure of the web and to obtain a hard compact roll. When the web from such a roll is removed from the compact roll and exposed to heat, a lofty structure can be regenerated. This lofty structure will show a degree of compression resistance similar to that seen for the initial never-compressed lofty thru-air bonded web.

SUMMARY OF THE INVENTION

The nonwoven fabric provided by this invention is a high loft composite that has strength, softness, and compression resistance sufficient to make it suitable for use in constructing absorbent products such as disposable diapers and sanitary napkins. The high loft fabrics of this invention result from a compressed web that can then be transformed into a lofty web with properties nearly matching those of a never-compressed bicomponent thru-air bonded fabric. The high loft fabrics are especially useful as coverstock and spacer fabrics for diapers showing improved softness and surface dryness.

In the first approach, a bicomponent-fiber-containing thru-air-bonded web is compressed in a nip as it exits the thru-air bonding oven. Since the nip is adjacent to the thru-air oven, it seems reasonable to assume that the fibers are still at the bonding temperature seen within the oven. Thus the temperature is at or at least near that at which the fiber state of aggregation is changing. No effort is made to hold the web in compression as it is moved toward the winder after it passes through the nip. It is presumed that significant cooling takes place during this period.

In the second approach, a bicomponent-fiber-containing thru-air-bonded web is formed as a lofty web, but then is wound at room temperature under sufficient tension to destroy the lofty structure of the web and to obtain a hard compact roll.

Fabric made by either approach—when unwound from the compact roll—can be transformed back into a lofty structure by exposure to heat.

DESCRIPTION OF THE PREFERRED EMBODIMENTS

The nonwoven fabrics described by the invention result from a four-step process. Step one consists of forming a web or webs comprised of thermoplastic bicomponent fibers via carding or spunbond continuous filament processes well known in the nonwoven art. Step two consists of bonding the web from step one using a thru-air bonding system. In step three, the lofty thru-air bonded web is compressed into a dense nonwoven web. Step four consists of transforming this compressed web via heat exposure into a lofty web with properties similar to those for a never-compressed bicomponent thru-air bonded fabric.

Any type of crimped thermoplastic bicomponent fibers can be used in the manufacture of the high loft nonwoven fabrics of this invention. For example, sheath/core, side-by-side, and other types of bicomponent fibers can be used. A variety of thermoplastic resin combinations is available. The fibers are generally crimped via typical textile means, for example the stuffer box method or the gear crimp method, to achieve a predominately two-dimensional or "flat" crimp. However, uncrimped bicomponent fibers may be used in the soft facing layer, as may be three-dimensionally crimped (sterically-buckled) fibers. Contrary to the teachings of U.S. Pat. No. 4,642,484, three-dimensionally ("sterically") crimped fibers are not required to obtain a lofty fabric.

Crimped continuous filament bicomponent fibers resulting from spunbond processes can also be used to manufacture high loft nonwoven fabrics of this invention. Crimping of such fibers can, for example, be achieved by heat treatment of continuous filament nonsymetric bicomponent fibers.

Currently preferred fibers according to the present invention are the composites wherein the bicomponent fibers in the carded web are selected from the group consisting of sheath/core fibers of the following resin combinations: polyethylene/polypropylene, polyethylene/polyester, polypropylene/polyester, and copolyester/polyester. Specific examples of such fibers are 1.7 and 3 denier polyethylene/polyester sheath/core fibers available from BASF CORPORATION as Products 1051 and 1050, respectively; 2 and 3 denier copolyester/polyester sheath/core fibers available from CELANESE FIBERS as Type 354; and 1.5 and 3 denier polyethylene/polypropylene sheath/core fibers available from CHORI AMERICA as Daiwabo NBF Type H.

High loft coverstock according to the present invention may be composed of two layers: a soft facing layer and a lofty layer to optimize the "rewet" properties of the composite. However, more than two layers could be used if desired in order to engineer additional properties into the composite. Multiple layers are discussed in a similar context in the Pirkkanen article cited hereinabove. On the other hand, a single layer approach may also be used.

The carded webs used for this invention need not be composed entirely of the bicomponent fibers. The desired balance of loft, softness, and strength determines the upper percent by weight of single component matrix fiber that can be added. Generally, both loft and softness increase and strength decreases as matrix (single component) fiber is added. Therefore, addition of greater than 25–30% matrix fiber may reduce the strength to a level of concern for use as a traditional diaper topsheet. However, with appropriate selection of bicomponent and matrix fibers by those skilled in the art, matrix fiber proportions of up to 50% or even greater can be used in the production of coverstock with good properties. A hollow polyester fiber has been found to be a particularly useful matrix fiber to promote the retention of caliper under loading conditions. Fabrics of this invention used inside the diaper construction, for example as spacer fabrics, may require less strength than fabrics used as coverstock. Thus higher matrix fiber proportions may be useful as long as compression resistance is maintained.

If a layered high loft coverstock is made according to this invention, the relative weights of the two layers in the composition will influence the balance of loft, softness, strength, and cost. Softness is optimized when the low denier layer makes up more than 50% of the basis weight. Thus the optimum ratio between the high and low denier layers will be dependent on the needed compromise of properties and cost, and can range from approximately 1:3 to 3:1.

Webs of crimped bicomponent fibers as prepared have natural high loft. It is important not to destroy that natural loft in the process of bonding the fibers of the web together. The preferred manner of fiber bonding is by "thru-air" bonding. In the thru-air bonding process, the web containing bicomponent fibers is exposed to air heated to a temperature such that the lower melting sheath part of the bicomponent fiber softens and begins to melt. Contact of this molten filament with a second filament will upon cooling form a bond. Contact between fibers can be achieved by the natural compression of gravity, the force of a moving stream of heated air against the fibers, and/or by a hold-down wire that puts a compressing force against the filaments to promote bonding.

The present invention can be practiced using fabrics made with or without a hold-down wire. The heated air can be introduced into the web of bicomponent fibers in a very uniform way to maximize uniform bonding of filaments to each other. Alternatively the air can be introduced according to a pattern so that intermittent bonding is achieved in those areas of concentrated air flow. Thur-air pattern bonding is discussed in U.S. Pat. No. 4,548,856 and U.K. Patent Application 2,127,865A, the disclosures of which are incorporated herein by reference. Both of these references, however, appear to teach the use of hold-down wires.

Uniform fiber bonding is promoted if the wire or drum supporting the web during air introduction is very open. Pattern bonding is promoted if the wire or drum supporting the web during air introduction has a pattern of open and closed areas such that the closed areas made up a substantial portion of the total area of the wire or drum. It is believed that such a structure of intermittent bonding achieved by use of a wire or drum of reduced open area in the absence of a hold-down wire will yield a bonded web with an especially attractive balance of loft, softness, and strength.

The webs of this invention may be thru-air bonded by the use of bonding surfaces such as wires or drums that have approximately 25–60 percent open area. By "percent open area" is meant the fraction of the bonding surface that is open so that hot air can move from the heat source through the web of bicomponent fibers. A particularly useful way to produce the coverstock of this invention is to use a bonding drum having approximately 30–40% open area. Retention of high loft is maximized by not using a hold-down wire.

After thru-air bonding the lofty web of this invention must be converted to a compressed state to allow winding into tight hard rolls of long linear yardage. We have found two methods to be particularly useful for achieving this conversion.

The first method to achieve a compressed web consists of subjecting the lofty thru-air bonded web to compression in a nip. A preferred method is to compress the web with a nip from two rolls that form the exit from the thru-air bonding oven such that the fibers are still at or near their bonding temperature. The nip should provide sufficient compression force to reduce the web caliper to 70% or less of its initial lofty value to insure that the resulting web can be wound up as a hard compact roll. Compression at the nip of 50–150 pounds per linear inch has been found to yield useful compressed webs. Contrary to the teaching of U.S. Pat. No. 4,601,937, no special care or equipment was needed to hold these webs under compression as they cooled after exiting the nip. The resulting compressed webs can be wound up as hard compact rolls of significant linear yardage.

A second method to achieve a compressed web consists of simply winding the lofty web at room temperature under sufficient tension to destroy the lofty structure of the web and obtain a hard compact roll. The tension must be sufficient so that the caliper of a sample removed from the roll is reduced to at least about 70% or less of its initial thru-air bonded lofty value. Note that contrary to the teaching of U.S. Pat. No. 4,601,937, no heat is needed to achieve this conversion of a lofty web into a compressed web that can be wound up as a hard compact roll of significant linear yardage.

These wound up rolls of compressed web can be conveniently transported from their place of manufacture to another location prior to their conversion (along with impermeable bottom sheeting and absorbent layers) into personal care products. Those skilled in the art of manufacture, of disposable diapers for instance, will recognize that other manipulative steps—for example, roll changing—will also be facilitated by the compressed webs provided by the present invention.

While we contemplate that the compressed webs be rebulked in connection with their conversion, as discussed below and illustrated in the Examples, the precursor compressed web may advantageously—due to its superior softness—be used without rebulking, if desired, in the conversion process.

The final step in preparing nonwoven fabrics of our invention consists of subjecting the above described compressed webs to sufficient heat under minimum compression so that loft will be regenerated. The temperature needed to achieve rebulking of the compressed web can be easily determined by heating small samples of the compressed web in a circulating air oven for a few seconds and noting what temperature will give maximum increase in loft to occur. At the optimum temperature, a 50% increase in loft should occur and often a final loft equal or greater to that seen for never compressed thru-air bonded lofty fabric will be observed. o The resulting rebulked nonwoven fabric because of its combination of loft, softness, and strength is useful for constructing absorbent products such as disposable diapers and sanitary napkins. These rebulked nonwoven fabrics of our invention are especially useful as coverstock and spacer fabrics in absorbent personal care products.

ILLUSTRATIVE EXAMPLES

In the examples that follow, the expression "gm/sqy" means "grams per square yard", the expression "gm/sqi" means grams per square inch, and the expression "psi" means "pounds per square inch". Basis weight was determined by measuring the weight of a known area of fabric. The result, reported as grams per square yard ("gm/sqy"), is the average of at least 4 measurements.

Following is a description of the test methods used to evaluate the products described in the Examples.

STRIP TENSILE STRENGTH

Strip tensile strength was evaluated by breaking a one inch by seven inch long sample generally following ASTM D1682-64, the One-Inch Cut Strip Test. The instrument cross-head speed was set at 5 inches per minute and the gauge length was set at 5 inches. The tensile strength in both the machine direction ("MD") and cross direction ("CD") was evaluated. The Strip Tensile Strength or breaking load, reported as grams per inch, is the average of at least 8 measurements.

CALIPER (UNDER COMPRESSION)

Caliper was determined by measuring the distance between the top and the bottom surface of the sheet while the sheet was held under compression loading of 19 grams per square inch, 107 grams per square inch, or 131 grams per square inch. The result, reported in mils, is the average of 10 measurements.

DENSITY

Density under 107 grams per square inch compression was calculated by dividing the fabric basis weight by the caliper measured under 107 grams per square inch compression loading. Multiplication by the proper conversion factors yields density as grams per cubic centimeter.

STRIKE-THROUGH

Strike-through was evaluated by a method similar to that described in U.S. Pat. Nos. 4,391,869 and 4,041,451. Strike-through was measured as the time for 5 milliliters of synthetic urine solution placed in the cavity of the strike-through plate to pass through the Example Fabric into an absorbent pad. The result, reported in seconds, is generally the average of 4 tests.

SURFACE WETNESS

Surface Wetness was evaluated by a method similar to that described in U.S. Pat. Nos. 4,041,951 and 4,391,861. Surface Wetness, reported in grams, was evaluated by adding synthetic urine through the Example Fabric into the absorbent pad until the absorbent pad was nearly saturated. Thus the Example Fabric was wet at the beginning of the Surface Wetness test. For results denoted as Surface Wetness 1, the loading factor was slightly less than 4 (grams of synthetic urine per gram of absorbent sample). A uniform pressure loading of 0.5 psi was then applied and the procedure concluded as disclosed in the above patents. For results denoted as Surface Wetness 2, the loading factor was increased to slightly over 4 so the absorbent pad was saturated with synthetic urine. A uniform pressure loading of 1.0 psi was then applied and the procedure concluded as disclosed in the above patents. The result, reported in grams, is generally the average of 4 tests.

SOFTNESS

Softness was evaluated by an organoleptic method wherein an expert panel compared the surface reel of Example Fabrics with that of controls. Results are reported as a softness score with higher values denoting a more pleasing hand. Each reported value is for a single fabric test sample but reflects the input of several panel members.

Examples For Compressed Web Approach

The first, or "compressed web" approach, features the following steps:

1. Thru-air bonding of a bicomponent web.
2. Compression of the web in a nip as it exits the thru-air bonding oven.
3. Winding the compressed web into a compact roll.
4. Releasing the compacted compressed web from the roll.
5. Exposing the compressed web to heat in the form of hot air to regenerate a lofty web.

Following are examples of the initial never-compressed web, the web after compressing, and results for the web after bulk regeneration.

EXAMPLE 1

Control 512-08. A carded web having a basis weight of 16 gm/sqy and composed of 100% 3 denier flat-crimped polyethylene/polyester sheath/core bicomponent fiber was laid on a moving belt. This high denier layer was overlaid with a carded web having a basis weight of 16 gm/sqy and consisting of 100% 1.7 denier flat-crimped polyethylene/polyester sheath/core bicomponent fiber. The two-layered assembly was supported on a rotating bonding drum having 35% open area such that air heated to 128°-130° C. was blown through the assembly for an exposure time of approximately 17 seconds. The web was compressed together by the air velocity moving through the web into the patterned open areas of the bonding drum. No hold-down wire was used.

The resulting composite nonwoven fabric, showing a basis weight of 32 gm/sqy, had these properties. The fabric has a MD strip tensile strength of 1405 grams per inch and a CD Strip Tensile Strength of 295 grams per inch. Its Caliper under compression was, at 19 gm/sqy 76 mils, at 107 gm/sqi, 45 mils, and, at 131 gm/sqi, 45 mils. Density under 107 gm/sqi compression was 0.034 gm/cm$^3$. Strike-through was 0.76 seconds. Surface Wetness 1 was 0.20 grams; surface wetness 2 was 0.56 grams. The topside softness rating was 85; bottom side softness was 85.

The rapid strike-through coupled with the low surface wetness 1 and 2 values make this fabric, Control 512-08, a very attractive diaper topsheet candidate. However the high loft, responsible for the attractive strike-through and surface wetness 1 and 2 values, make rolls of this product very bulky and thus expensive to ship and convert on the diaper machine.

Precursor 512-07. The composite nonwoven fabric described above was compressed in a nip as it exited the bonding oven such that the caliper was substantially reduced.

The resulting compressed nonwoven fabric, showing a basis weight of 38 gm/sqy, had these properties: The fabric has a MD strip tensile strength of 1579 grams per inch and a CD strip tensile strength of 402 grams per inch. Its caliper under compression was, at 19 gm/sqi, 45 mils, at 107 gm/sqi 25 mils, and at 131 gm/sqi, 28 mils. Strike-through was 1.1 seconds. Surface wetness 1 was 0.26 grams; surface wetness 2 was 1.28 grams. Density under 107 gm/sqi compression was 0.072 gm/cm$^3$. The topside softness rating was 88; bottom side softness was 78.

Precursor 512-07, because of the greatly reduced calipers and high tensile strength could be wound into tight rolls of long yardage. Thus the problems of shipping and converting are solved. However the strike-through value and surface wetness 1 were increased. The surface wetness 2 values have been increased by more than an a factor of two. Thus Precursor 512-07 no longer has the attractive dryness properties seen in Control 512-08.

Topsheet 512-07A. Products of this invention were made by bulking samples of Precursor 512-07 via exposure to air heated to an elevated temperature of 170° C. for 15 seconds in a circulating air oven.

The bulked Topsheet 512-07A, a product of this invention, was characterized. It showed a MD strip tensile strength of 1584 grams per inch and a CD strip tensile strength of 361 grams per inch. Its caliper under compression was, at 19 gm/sqi, 80 mils, at 107 gm/sqi, 50 mils, and at 131 gm/sqi, 38 mils. Strike-through was 0.99 seconds. Surface wetness 1 was 0.49 grams; surface wetness 2 was 0.42 grams. Density under 107 gm/sqi compression was 0.036 gm/cm$^3$. The topside softness rating was 78; bottomside softness was 82.

Bulking of Precursor 512-07 to yield topsheet 512-07A, a product of this invention, has regenerated the attractive combination of strike-through properties and surface wetness first seen in Control 512-08. Products of our invention—being made from bicomponent fibers in a compressed state for easy transportation and processing yet easily converted via bulking to thick topsheet with superior strike-through and surface wetness—constitute a significant advance in the art of diaper topsheet constructions.

EXAMPLE 2

Control 512-12. A carded web having a basis weight of 14 gm/sqy and composed of 100% 3 denier flat-crimped polyethylene/polyester sheath/core bicomponent fiber was laid on a moving belt. This high denier layer was overlaid with a carded web having a basis weight of 9 gm/sqy and consisting of 100% 1.7 denier flat-crimped polyethylene/polyester sheath/core bicomponent fiber. The two layered assembly was supported on a rotating bonding drum having 35% open area such that air heated to 130° C. was blown through the assembly for an exposure time of approximately 17 seconds. The web was compressed together by the air velocity moving through the web into the patterned open areas of the bonding drum. No hold-down wire was used.

The resulting composite nonwoven fabric, showing a basis weight of 23 gm/sqy, has these properties: The fabric had a MD strip tensile strength of 1208 grams per inch and a CD strip tensile strength of 318 grams per inch. Its caliper under compression was, at 19 gm/sqi, 60 mils, at 107 gm/sqi, 35 mils, and, at 131 gm/sqi, 35 mils. Density under 107 gm/sqi compression 0.031 gm/cm$^3$. Strike-through was 0.98 seconds. Surface wetness 1 was 0.22 grams; surface wetness 2 was 0.44 grams. The topside softness rating was 85; bottom side softness was 85.

The rapid strike-through coupled with the low surface wetness 1 and 2 values make Control 512-12 a very attractive diaper topsheet candidate. However the high loft, responsible for the attractive strike-through and surface wetness 1 and 2 values, make rolls of this product very bulky thus expensive to ship and convert on the diaper machine.

Precursor 512-13. The composite nonwoven fabric described in Example 512-12 was compressed in a nip as it exited the bonding oven such that the caliper was substantially reduced.

The resulting compressed nonwoven fabric, showing a basis weight of 29 gm/sqy, had these properties: The fabric had a MD strip tensile strength of 1632 grams per inch and a CD strip tensile strength of 436 grams per inch. Its caliper under compression was, at 19 gm/sqi, 31 mils, at 107 gm/sqi, 24 mils, and at 131 gm/sqi, 21 mils. Strike-through was 1.9 seconds. Surface wetness 1 was 1.6 grams; surface wetness 2 was 1.6 grams. Density under 107 gm/sqi compression was 0.057 gm/cm$^3$.

Precursor 512-13, because of the greatly reduced calipers and high tensile strength could be wound into tight rolls of long yardage. Thus the problems of shipping and converting are solved. However the strike-through value has been somewhat increased and the surface wetness 1 and 2 values have been very significantly increased. This product no longer has the attractive dryness properties seen in Control 512-12.

Topsheet 512-13A. Products of this invention were made by bulking samples of 512-13 via exposure to air heated to an elevated temperature of 170° C. for 15 seconds in a circulating air oven.

The bulked Topsheet 512-13A, a product of this invention, was characterized. It showed a MD strip tensile strength of 1514 grams per inch and a CD strip tensile strength of 238 grams per inch. Its caliper under compression was, at 19 gm/sqi, 57 mils, at 107 gm/sqi, 40 mils, and at 131 gm/sqi, 41 mils. Strike-through was 0.8 seconds. Surface wetness 1 was 0.50 grams; surface wetness 2 was 0.52 grams. Density under 107 gm/sqi compression was 0.034 gm/cm$^3$.

Bulking of 512-13 to yield 512-13A, a product of this invention, has regenerated the attractive combination of strike-through properties and surface wetness first seen in 512-12. Products of our invention, being made from bicomponent fibers in a compressed state for easy transportation and processing yet easily converted via bulking to thick topsheet with superior strike-through and surface wetness is a significant advance in the art of diaper topsheet constructions.

EXAMPLE 3

Control 516-07. A carded web having a basis weight of 18 gm/sqy and composed of 100% 3 denier flat-crimped polyethylene/polypropylene sheath/core bicomponent fiber was laid on a moving belt. This high denier layer was overlaid with a carded web having a basis weight of 11 gm/sqy and consisting of 100% 1.5 denier flat-crimped polyethylene/polypropylene sheath/core bicomponent fiber. The two layered assembly was supported on a rotating bonding drum having 35% open area such that air heated to 128°-130° C. was blown through the assembly for an exposure time of approximately 17 seconds. The web was compressed together by the air velocity moving through the web into the patterned open areas of the bonding drum. No hold-down wire was used.

The resulting composite nonwoven fabric, showing a basis weight of 29 gm/sqy, had these properties: The fabric had a MD strip tensile strength of 2192 grams per inch and a CD strip tensile strength of 706 grams per inch. Its caliper under compression was, at 19 gm/sqi, 23 mils, at 107 gm/sqi, 17 mils, and at 131 gm/sqi, 18 mils. Strike-through was 2.7 seconds. Surface Wetness 1 was 0.11 grams; surface wetness 2 was 0.60 grams. Density under 107 gm/sqi compression was 0.080 gm/cm$^3$. The topside softness rating was 28; bottom side softness was 58.

The rapid strike-through coupled with the low surface wetness 1 and 2 values make Control 516-07 a very attractive diaper topsheet candidate. However the high loft, responsible for the attractive strike-through and surface wetness 1 and 2 values, make rolls of this product very bulky thus expensive to ship and convert on the diaper machine.

Precursor 516-08. The composite nonwoven fabric described in Control 516-07 was compressed in a nip as it exited the bonding oven such that the caliper was substantially reduced.

The resulting compressed nonwoven fabric, showing a basis weight of 28 gm/sqy, had these properties: The fabric had a MD strip tensile strength of 1358 grams per inch and a CD strip tensile strength of 461 grams per inch. Its caliper under compression was, at 19 gm/sqi, 19 mils, at 107 gm/sqi, estimated as 13 mils, and at 131 gm/sqi, 13 mils. Strike-through was 1.7 seconds. Surface wetness 1 was 0.13 grams; surface wetness 2 was 0.84 grams. Density under 107 gm/sqi compression was estimated as 0.101 gm/cm$^3$. The topside softness rating was 48; bottom side softness was 62.

Precursor 516-08, because of the greatly reduced calipers and high tensile strength could be wound into tight rolls of long yardage. Thus the problems of shipping and converting are solved. However the surface wetness value suggest some lose in the attractive dryness properties seen in the control 516-07.

Topsheet 516-08A. Products of this invention were made by bulking samples of 516-08 via exposure to air heated to an elevated temperature of 135° C. for 15 seconds in a circulating air oven.

The bulked Topsheet 516-08A, a product of this invention, was characterized. It showed a MD strip tensile strength of 1312 grams per inch and a CD strip tensile strength of 434 grams per inch. Its caliper under compression was, at 19 gm/sqi, 29 mils, and at 107 gm/sqi, estimated as 20 mils, and at 131 gm/sqi, 20 mils. Strike-through was 1.9 seconds. Surface wetness 1 was 0.12 grams; surface wetness 2 was 0.19 grams. Density under 107 gm/sqi compression was estimated as 0.066 gm/cm$^3$. The topside softness rating was 48; bottom side softness was 48.

Bulking of 516-08 to yield 516-08A, a product of this invention, has regenerated the attractive combination of strike-through properties and surface wetness first seen in 516-07. Products of our invention, being made from bicomponent fibers in a compressed state for easy transportation and processing yet easily converted via bulking to thick topsheet with superior strike-through and surface wetness, represent a significant advance in the art of diaper topsheet constructions.

EXAMPLE 4

Control 512-15. A carded web having a basis weight of 8.5 gm/sqy and composed of 100% 3 denier flat-crimped polyethylene/polyester sheath/core bicomponent fiber was laid on a moving belt. This high denier layer was overlaid with a carded web having a basis weight of 16.5 gm/sqy and consisting of 100% 1.7 denier flat-crimped polyethylene/polyester sheath/core bicomponent fiber. The two layered assembly was supported on a rotating bonding drum having 35% open area such that air heated to 129° C. was blown through the assembly for an exposure time of approximately 17 seconds. The web was compressed together by the air velocity moving through the web into the patterned open areas of the bonding drum. No hold-down wire was used.

The resulting composite nonwoven fabric, showing a basis weight of 25 gm/sqy, had these properties: The fabric had a MD strip tensile strength of 1425 grams per inch and a CD strip tensile strength of 291 grams per inch. Its caliper under compression was, at 19 gm/sqi 61 mils, at 107 gm/sqi, 38 mils, and, at 131 gm/sqi, 36 mils. Strike-through was 0.98 seconds. Surface wetness 1 was 0.13 grams; surface wetness 2 was 0.33 grams. The softness rating was not obtained. Density under 107 gm/sqi compression was 0.0310 gm/cm$^3$.

The rapid strike-through coupled with the low surface wetness 1 and 2 values make Control 512-15 a very attractive diaper topsheet candidate. However the high loft, responsible for the attractive strike-through and surface wetness 1 and 2 values, make rolls of this product very bulky thus expensive to ship and convert on the diaper machine.

Precursor 512-16. The composite nonwoven fabric described in Example 512-15 was compressed in a nip as it exited the bonding oven such that the caliper was substantially reduced.

The resulting compressed nonwoven fabric, showing a basis eight of 30 gm/sqy, had these properties: The fabric had a MD strip tensile strength of 1550 grams per inch and a CD strip tensile strength of 601 grams per inch. Its caliper under compression was, at 19 gm/sqi, 13 mils, at 107 gm/sqi 10 mils, and at 131 gm/sqi, 9 mils. Strike-through was 1.8 seconds. Surface wetness 1 was 2.85 grams; surface wetness 2 was 3.06 grams. Density under 107 gm/sqi compression was 0.141 gm/cm$^3$.

Precursor 512-16, because of the greatly reduced calipers and high tensile strength could be wound into tight rolls of long yardage. Thus the problems of shipping and converting are solved. However the strike-through value has been somewhat increased and the surface wetness 1 and 2 values have been increased by more than an order of magnitude. Thus Precursor 512-16 no longer has the attractive dryness properties seen in Control 512-15.

Topsheet 512-16A. Products of this invention were made by bulking samples of 512-16 via exposure to air heated to an elevated temperature of 170° C. for 15 seconds in a circulating air oven.

The bulked Topsheet 512-16A, a product of this invention, was characterized. It showed a MD strip tensile strength of 1774 grams per inch and a CD strip tensile strength of 594 grams per inch. Its caliper under compression was, at 19 gm/sqi, 31 mils, at 107 gm/sqi, 18 mils, and at 131 gm/sqi, 23 mils. Strike-through was 1.2 seconds. Surface wetness 1 was 0.74 grams; surface wetness 2 was 1.33 grams. Density under 107 gm/sqi compression was 0.078 gm/cm$^3$.

Bulking of 512-16 to yield 512-16A, a product of this invention, gave a candidate with an improved combination of strike-through properties and surface wetness. Products of our invention, being made from bicomponent fibers in a compressed state for easy transportation and converting yet easily converted via bulking to thick topsheet with superior strike-through and surface wetness, constitute a significant advance in the art of diaper topsheet constructions.

EXAMPLE 5

Control 520-07. A carded web having a basis weight of 17 gm/sqy and composed of 100% 3 denier flat-crimped polyethylene/polyester sheath/core bicomponent fiber was laid on a moving belt. This high denier layer was overlaid with a carded web having a basis weight of 8 gm/sqy and consisting of 100% 2 denier flat-crimped polyethylene/polyester sheath/core bicomponent fiber. The two layered assembly was supported on a rotating bonding drum having 35% open area such that air heated to 128°-129° C. was blown through the assembly for an exposure time of approximately 17 seconds. The web was compressed together by the air velocity moving through the web into the patterned open areas of the bonding drum. No hold-down wire was used.

The resulting composite nonwoven fabric, showing a basis weight of 25 gm/sqy, had these properties. The fabric had a MD strip tensile strength of 1473 grams per inch and a CD strip tensile strength of 305 grams per inch. Its caliper under compression was, at 19 gm/sqi, 51 mils, at 107 gm/sqi, 30 mils, and, and 131 gm/sqi, 34 mils. Strike-through was 1.7 seconds. Surface wetness 1 was 0.13 grams; surface wetness 2 was 0.14 grams. The topside softness rating was 30; bottom side softness was 68. Density under 107 gm/sqi compression was 0.039 gm/cm$^3$.

The rapid strike-through coupled with the low surface wetness 1 and 2 values make Control 520-07 a very attractive diaper topsheet candidate. However the high loft, responsible for the attractive strike-through and surface wetness 1 and 2 values, make rolls of this product very bulky thus expensive to ship and convert on the diaper machine.

Precursor 520-08. The composite nonwoven fabric described in Example 520-07 was compressed in a nip as it exited the bonding oven such that the caliper was substantially reduced.

The resulting compressed nonwoven fabric, showing a basis weight of 27 gm/sqy, had these properties: The fabric had a MD strip tensile strength of 2031 grams per inch and a CD strip tensile strength of 576 grams per inch. Its caliper under compression was, at 19/sqi, 11 mils, at 107 gm/sqi, 7 mils, and at 131 gm/sqi, 7 mils. Strike-through was 2,5 seconds. Surface wetness 1 was 2.4 grams; surface wetness 2 was 3.5 grams. The topside softness rating was 40; bottomside softness was 78. Density under 107 gm/sqi compression was 0.182 gm/cm$^3$.

Example 520-08, because of the greatly reduced calipers and high tensile strength could be wound into tight rolls of long yardage. Thus the problems of shipping and converting are solved. However the strike-through value has been somewhat increased and the surface wetness 1 and 2 values have been increased by more than an order of magnitude. Thus Example 520-08 no longer has the attractive dryness properties seen in Example 520-07.

Topsheets 520-08A, 520-08B, and 520-08C. Products of this invention were made by bulking samples of 520-08 via exposure to air heated to an elevated temperature, for 15 seconds in a circulating air oven. Bulked product 520-08A yielded a caliper, measured under compression of 107 gm/sqi, of 17 mils after 15 second exposure to air heated to 135° C. Bulked product 520-08B yielded a caliper, measured under compression of 107 gm/sqi, of 21 mils after 15 second exposure to air heated to 150° C. Bulked product 520-08C yielded a caliper, measured under compression of 107 gm/sqi, of 20 mil after 15 second exposure to air heated to 170° C.

The bulked Topsheet 520-08B, a product of this invention, was further characterized. It showed a MD strip tensile strength of 2113 grams per inch and a CD strip tensile strength of 588 grams per inch. Its caliper under compression was, at 19 gm/sqi, 40 mils, in a second test at 107 gm/sqi, 20 mils, and at 131 gm/sqi, 24 mils. Strike-through was 1.6 seconds. Surface wetness 1 was 0.12 grams; surface wetness 2 was 0.38 grams. Density under 107 gm/sqi compression was 0.064 gm/cm$^3$. The topside softness rating was -1; bottomside softness was 15.

Bulking of 520-08 to yield 520-08B, a product of this invention, has regenerated the attractive combination of strike-through properties and surface wetness first seen in 520-07. Products of our invention—being made from bicomponent fibers in a compressed state for easy transportation and converting yet easily converted via bulking to thick topsheet with superior strike-through and surface wetness—constitute a significant advance in the art of diaper topsheet constructions.

EXAMPLE 6

Control 520-09. A carded web having a basis weight of 10.5 gm/sqy and composed of 100% 3 denier flat-crimped polyethylene/polyester sheath/core bicomponent fiber was laid on a moving belt. This high denier layer was overlaid with a carded web having a basis weight of 18.5 gm/sqy and consisting of 100% 2 denier flat-crimped polyethylene/polyester sheath/core bicomponent fiber. The two layered assembly was supported on a rotating bonding drum having 35% open area such that air heated to 128°-129° C. was blown through the assembly for an exposure time of approximately 17 seconds. The web was compressed together by the air velocity moving through the web into the patterned open areas of the bonding drum. No hold-down wire was used.

The resulting composite nonwoven fabric, showing a basis weight of 29 gm/sqy, had these properties: The fabric had a MD strip tensile strength of 1905 grams per inch and a CD strip tensile strength of 432 grams per inch. Its caliper under compression was, at 19 gm/sqi, 54 mils, at 107 gm/sqi, 36 mils, and, at 131 gm/sqi, 35 mils. Strike-through was 1,8 seconds. Surface wetness 1 was 0.13 grams; surface wetness 2 was 0.16 grams. Density under 107 gm/sqi compression was 0.038 gm/cm$^3$.

The rapid strike-through coupled with the low surface wetness 1 and 2 values make Example 520-09 a very attractive diaper topsheet candidate. However the high loft, responsible for the attractive strike-through and surface wetness values, make rolls of this product very bulky thus expensive to ship and convert on the diaper machine.

Precursor 520-10. The composite nonwoven fabric described in Control 520-09 was compressed in a nip as it exited the bonding oven such that the caliper was substantially reduced.

The resulting compressed nonwoven fabric, showing a basis weight of 28 gm/sqy, had these properties: The fabric had a MD strip tensile strength of 2917 grams per inch and a CD strip tensile strength of 591 grams per inch. Its caliper under compression was at 19 gm/sqi, 9 mils, at 107 gm/sqi, 5 mils, and at 131 gm/sqi, 7 mils. Strike-through was 3.1 seconds. Surface wetness 1 was 3.3 grams; surface wetness 2 was 4.0 grams. Density under 107 gm/sqi was 0.264 gm/cm$^3$. The topside softness rating was 2; bottomside softness was 25.

Precursor 520-10, because of the greatly reduced calipers and high tensile strength could be wound into tight rolls of long yardage. Thus the problems of shipping and converting are solved. However the strike-through value has been somewhat increased and the surface wetness 1 and 2 values have been increased by more than an order or magnitude. Thus Precursor 520-10 no longer has the attractive dryness properties seen in Example 520-09.

Topsheets 520-10A, 520-10B, and 520-10C. Products of this invention were made by bulking samples of 520-09 via exposure to air heated to an elevated temperature for 15 seconds in a circulating air oven. Bulked product 520-10A yielded a caliper, measured under compression of 107 gm/sqi, of 24 mils after 15 seconds exposure to air heated to 135° C. Bulked product 520-10B yielded a caliper, measured under compression of 107 gm/sqi, of 23 mils after 15 second exposure to air heated to 150° C. Bulked product 520-10C yielded a caliper, measured under compression of 107 gm/sqi, of 18 mil after 15 second exposure to air heated to 170° C.

The bulked Topsheet 520-10B, a product of this invention, was further characterized. It showed a MD strip tensile strength of 2716 grams per inch and a CD strip tensile strength of 783 grams per inch. Its caliper under compression was at 19 gm/sqi, 42 mils, in a second test at 107 gm/sqi, 25 mils, and at 131 gm/sqi, 28 mils. Density under 107 gm/sqi compression was 0.053 gm/cm$^3$. Strike-through was 1.9 seconds. Surface wetness 1 was 0.10 grams; surface wetness 2 was 0.26 grams. The topside softness rating was 10; bottomside softness was 85.

Bulking of 520-09 to yield 520-10B, a product of this invention, has regenerated the attractive combination of strike-through properties and surface wetness first seen in 520-09. Products of our invention, being made from bicomponent fibers in a compressed state for easy transportation and converting yet easily converted via bulking to thick topsheet with superior strike-through and surface wetness, are a significant advance in the art of diaper topsheet constructions.

EXAMPLE 7

Control 521-02. A carded web having a basis weight of 18 gm/sqy and composed of 100% 3 denier flat-crimped polyethylene/polyester sheath/core bicomponent fiber was laid on a moving belt. This layer was overlaid with a carded web having a basis weight of 18 gm/sqy and also consisting of 100% 3 denier flat-crimped polyethylene/polyester sheath/core bicomponent fiber. The two layered assembly was supported on a rotating bonding drum having 35% open area such that air heated to 128°-129° C. was blown through the assembly for an exposure time of approximately 17 seconds. The web was compressed together by the air velocity moving through the web into the patterned open areas of the bonding drum. No hold-down wire was used.

The resulting nonwoven fabric, showing a basis weight of 36 gm/sqy, had these properties: The fabric had a MD strip tensile strength of 1504 grams per inch and a CD strip tensile strength of 376 grams per inch. Its caliper under compression was, at 19 gm/sqi, 60 mils, at 107 gm/sqi, 40 mils, and, at 131 gm/sqi, 40 mils. Density under 107 gm/sqi compression was 0.042 g/cm$^3$. Strike-through was 1.2 seconds. Surface wetness 1 was 0.12 grams; surface wetness 2 was 0.21 grams. The topside softness rating was 70; bottomside softness was 75.

The rapid strike-through coupled with the low surface wetness 1 and 2 values make Control 521-02 a very attractive diaper topsheet candidate. However the high loft, responsible for the attractive strike-through and surface wetness 1 and 2 values, make rolls of this product very bulky thus expensive to ship and convert on the diaper machine.

Precursor 531-03. The composite nonwoven fabric described in Example 521-02 was compressed in a nip as it exited the bonding oven such that the caliper was substantially reduced.

The resulting compressed nonwoven fabric, showing a basis weight of 28 gm/sqy, had these properties: The fabric had a MD strip tensile strength of 1561 grams per inch and a CD strip tensile strength of 733 grams per inch. Its caliper under compression was, at 19 gm/sqi, 22 mils, at 107 gm/sqi, 16 mil, and at 131 gm/sqi, 15 mils. The density under 107 gm/sqi compression was 0.082 g/cm$^3$. Strike-through was 1.4 seconds. Surface wetness 1 was 0.14 grams; surface wetness 2 was 2.91 grams. The topside softness rating was 77.5; bottomside softness was 77.5.

Precursor 521-03, because of the greatly reduced calipers and high tensile strength could be wound into tight rolls of long yardage. Thus the problems of shipping and converting are solved. However the strike-through value and surface wetness 1 were increased.

The surface wetness 2 values have been increased by more than an order of magnitude. Thus Precursor 521-03 no longer has the attractive dryness properties seen in Control 521-02.

Topsheets 521-03A, 521-03B, 521-03C. Products of this invention were made by bulking samples of 521-03 via exposure to air heated to an elevated temperature for 15 seconds in a circulating air oven. Bulked product 521-03A yielded a caliper, measured under compression of 107 gm/sqi, of 43 mil after 15 second exposure to air heated to 135° C. Bulked product 521-03B yielded a caliper, measured under compression of 107 gm/sqi, of 39 mil after 15 second exposure to air heated to 150° C. Bulked product 521-03C yielded a caliper, measured under compression of 107 gm/sqi, of 34 mil after 15 second exposure to air heated to 170° C.

The bulked Topsheet 521-03A, a product of this invention, was further characterized. It showed a MD strip tensile strength of 1712 grams per inch and a CD strip tensile strength of 486 grams per inch. Its caliper under compression was, at 19 gm/sqi, 51 mils, a second test at 107 gm/sqi, 37 mils, and at 131 gm/sqi, 35 mils. Density under 107 gm/sqi compression was 0.036 g/cm$^3$. Strike-through was 1.2 seconds. Surface wetness 1 was 0.14 grams; surface wetness 2 was 0.62 grams. The topside softness rating was 78; bottomside softness was 78.

Bulking of 521-03 to yield 521-03A, a product of the invention, has regenerated the attractive combination of strike-through properties and surface wetness first seen in 521-02. Products of our invention, being made from bicomponent fibers in a compressed state for easy transportation and converting yet easily converted via bulking to thick topsheet with superior strike-through and surface wetness, are a significant advance in the art of diaper topsheet constructions.

EXAMPLE 8

Control 540-07. A carded web having a basis weight of 14 gm/sqy and composed of a blend of 70% 3 denier copolyester/polyester sheath/core bicomponent fiber and 30% 5.5 denier hollow polyester matrix fiber was laid on a moving belt. This high denier layer was overlaid with a carded web having a basis weight of 14 gm/sqy and consisting of a blend of 50% 2 denier copolyester/polyester sheath/core bicomponent fiber and 50% 1.5 denier polyester matrix fiber. The two-layered assembly was supported on a rotating bonding drum having 35% open area such that air heated to 200° C. was blown through the assembly for an exposure time of approximately 17 seconds. The web was compressed together by the air velocity moving through the web into the patterned open areas of the bonding drum. No hold-down wire was used.

The resulting composite nonwoven fabric, showing a basis weight of 28 gm/sqy, had these properties: The fabric has a MD strip tensile strength of 1158 grams per inch and a CD Strip Tensile Strength of 298 grams per inch. Its Caliper under compression was, at 19 gm/sqy, 53 mils, at 107 gm/sqi, 33 mils, and at 131 gm/sqi, 34 mils. Density under 107 gm/sqi compression was 0.040 gm/cm$^3$. Strike-through was 1.1 seconds. Surface wetness was 0.20 grams; surface wetness 2 was 0.40 grams. The topside softness rating was 50; bottom side softness was 38.

The rapid strike-through coupled with the low surface wetness 1 and 2 values make this fabric, Control 540-07, a very attractive diaper topsheet candidate. However the high loft, responsible for the attractive strike-through and surface wetness 1 and 2 values, make rolls of this product very bulky, and thus expensive to ship and convert on the diaper machine.

Precursor 540-08. The composite nonwoven fabric described above was compressed in a nip as it exited the bonding oven such that the caliper was substantially reduced.

The resulting compressed nonwoven fabric, showing a basis weight of 24 gm/sqy, had these properties: The fabric had a MD strip tensile strength of 1400 grams per inch and a CD strip tensile strength of 342 grams per inch. Its caliper under compression was, at 19 gm/sqi, 12 mils, at 107 gm/sqi 12 mils, and at 131 gm/sqi, 10 mils. Strike-through was 1.8 seconds. Surface wetness 1 was 1.28 grams; surface wetness 2 was 1.32 grams. Density under 107 gm/sqi compression was 0.094 gm/cm$^3$. The topside softness rating was 45; bottom side softness was 28.

Precursor 540-08, because of the greatly reduced calipers and high tensile strength, could be wound into tight rolls of long yardage. Thus the problems of shipping and converting are solved. However the strike-through value has been increased. Both surface wetness 1 and 2 values have been substantially increased. Thus Precursor 540-08 no longer has the attractive dryness properties seen in Control 540-07.

Topsheet 540-08A. Products of this invention were made by bulking samples of Precursor 540-08 via exposure to air heated to an elevated temperature of 150° C. for 15 seconds in a circulating air oven.

The bulked Topsheet 540-08A, a product of this invention, was characterized. It showed a MD strip tensile strength of 1418 grams per inch and a CD strip tensile strength of 422 grams per inch. Its caliper under compression was, at 19 gm/sqi, 74 mils, at 107 gm/sqi, 36 mils, and at 131 gm/sqi, 40 mils. Strike-through was 0.99 seconds. Surface wetness 1 was 0.16 grams; surface wetness 1 was 0.22 grams. Density under 107 gm/sqi compression was 0.031 gm/cm$^3$. The topside softness rating was 52; bottomside softness was 30.

Bulking of Precursor 540-08 to yield Topsheet 540-08A, a product of this invention, has regenerated the attractive combination of strike-through properties and surface wetness first seen in Control 540-07. This product of our invention—which is made from blends of bicomponent fibers plus single component matrix fibers and which can be compressed for easy transportation and processing yet easily converted via bulking to thick topsheet with superior strike-through and surface wetness—is a significant advance in the art of diaper topsheet construction.

EXAMPLE 9

This example illustrates use of the "compressed web" approach to make a web useful as a spacer fabric between a thin coverstock fabric and the absorbent core of the diaper.

Control 521-06. A carded web having a basis weight of 16 gm/sqy and composed of 100% 3 denier flat-crimped polyethylene/polyester sheath/core bicomponent fiber was laid on a web of thin spunbounded polypropylene fabric sold by James River Corporation as CELESTRA fabric with basis weight of 12 gm/sqy. This type of fabric has been used for coverstock applications. The two-layer assembly was supported on a rotating bonding drum having 35% open area such that air heated to 129° C. was blown through the assembly for an exposure time of approximately 17 seconds. The carded web was compressed together by the air velocity moving through the web into the patterned open areas of the bonding drum. No hold-down wire was used. A mechanical bond was noted between the thru-air bonded bicomponent web and the thin spunbonded coverstock such that the webs held together during winding.

The resulting construction (composed of the thin topsheet fabric and bulky "spacer sheet" and showing a basis weight of 35 gm/sqy) had these properties: The fabric had a MD strip tensile strength of 2030 grams per inch and a CD strip tensile strength of 550 grams per inch. Its caliper under compression was, at 19 gm/sqi, 45 mils, at 107 gm/sqi, 30 mils, and, 131 gm/sqi, 32 mils. Strike-through was 2.2 seconds. Surface wetness 1 was 0.17 grams; surface wetness 2 was 0.18 grams. Density under 107 gm/sqi compression was 0.549 gm/cm$^3$.

Testing of a CELESTRA fabric similar to that used above with basis weight of 13 gsy yielded strike-through of 2.1 seconds and surface wetness 2 of 1.42 grams. The effect of the bulky spacer sheet is clearly seen by the large difference in surface wetness 2 values for the combination topsheet and spacer sheet versus thin topsheet itself.

The rapid strike-through coupled with the low surface wetness 1 and 2 values make Example 521-06 a very attractive diaper component candidate. However the high loft, responsible for the attractive strike-through and surface wetness values, make rolls of this product very bulky thus expensive to ship and convert on the diaper machine.

Precursor 521-07. The composite nonwoven construction described in 521-06, thin spunbond coversheet and bulky thru air bonded bicomponent fiber "spacer sheet", was compressed in a nip as it exited the bonding oven such that the caliper was substantially reduced.

The resulting compressed nonwoven fabric, showing a basis weight of 31 gm/sqy, had these properties: The fabric had a MD strip tensile strength of 2751 grams per inch and a CD strip tensile strength of 777 grams per inch. Its caliper under compression was, at 19 gm/sqi, 19 mils, at 107 gm/sqi, 16 mils, and at 131 gm/sqi, 15 mils. The density under 107 gm/sqi compression was 0.912 g/cm$^3$. Strike-through was 3.7 seconds. Surface wetness 1 was 0.15 grams; surface wetness 2 was 0.37 grams.

Precursor 521-03, because of the greatly reduced calipers and high tensile strength could be wound into tight rolls of long yardage. Thus the problems of shipping and converting are solved. However the strike-through value and surface wetness 2 were increased. Thus Precursor 521-07 no longer has the attractive dryness properties seen in Control 521-06.

Spacer Sheet 521-07A. A spacer sheet of this invention was made by bulking precursor 521-07, thin spunbonded coversheet and bulky thru-air bonded bicomponent fiber web, via exposure to air heated to 150° C. for 15 seconds in a circulating air oven. The bulked composite product yielded a basis weight of 31 gsy. It showed a MD strip tensile strength of 2197 grams per inch and a CD strip tensile strength of 577 grams per inch. Its caliper under compression was, at 19 gm/sqi, 43 mils, at 107 gm/sqi, 28 mils, and at 131 gm/sqi, 29 mils. Density under 107 gm/sqi compression was 0.524 g/cm$^3$. Strike-through was 2.1 seconds. Surface wetness 1 was 0.14 grams; surface wetness 2 was 0.27 grams.

Bulking 521-07 to yield 521-07A, demonstrating the production of a spacer sheet of this invention, has regenerated an attractive combination of strike-through properties and surface wetness nearly equal to that first seen in 521-06. Products of our invention, being made by bicomponent fibers in a compressed state for easy transportation and converting yet easily converted via bulking to thick fabric useful as a spacer sheet layer to yield superior strike-through and surface wetness, are a significant advance in the art of diaper construction.

EXAMPLES FOR WOUND WEB APPROACH

The second, or "wound web" approach, features the following steps:

1. Thru-air bonding of a bicomponent web.
2. Compression of the web by winding it into a tight roll.
3. Releasing the compacted web from the tight roll.
4. Exposing the web to heat in the form of hot air to regenerate a lofty web.

Following are examples of the initial lofty web, the compressed web formed after winding, and the web after loft regeneration.

EXAMPLE 10

Control 527-04. A carded web having a basis weight of 13.5 gm/sqy and composed of 100% 3 denier flat-crimped polyethylene/polyester sheath/core bicomponent fiber was laid on a moving belt. This layer was overlaid with a carded web having a basis weight of 13 gm/sqy and consisting of 100% 3 denier flat-crimped polyethylene/polyester sheath/core bicomponent fiber. The two layered assembly was supported on a rotating bonding drum having 35% open area such that air heated to 130° C. was blown through the assembly for an exposure time of approximately 17 seconds. The web was compressed together by the air velocity moving through the web into the patterned open areas of the bonding drum. No hold-down wire was used.

The resulting composite nonwoven fabric, showing a basis weight of 26.5 gm/sqy, had these properties: The fabric had a MD strip tensile strength of 1359 grams per inch and a CD strip tensile strength of 327 grams per inch. Its caliper under compression was, at 19 gm/sqi 69 mils, at 107 gm/sqi, 35 mils, and, at 131 gm/sqi, 36 mils. Density under 107 gm/sqi compression was 0.036 g/cm$^3$. Strike-through was 1.1 seconds. Surface wetness 1 was 0.12 grams; surface wetness 2 was 0.17 grams.

The rapid strike-through coupled with the low surface wetness 1 and 2 values make Control 527-04 a very attractive diaper topsheet candidate. However the high loft, responsible for the attractive strike-through and surface wetness 1 and 2 values, make rolls of this product very bulky and thus expensive to ship and convert on the diaper machine.

Precursor 527-04B. The composite nonwoven fabric described in Control 527-04 was mechanically compressed by winding into a very tight compact roll such that the caliper was substantially reduced.

The resulting compressed nonwoven fabric, showing a basis weight of 26.7 gm/sqy, had these properties: The fabric had a MD strip tensile strength of 1190 grams per inch and a CD strip tensile strength of 292 grams per inch. Its caliper under compression was, at 19 gm/sqi, 20 mils, at 107 gm/sqi 10 mils, and at 131 gm/sqi 10 mil. Density under 107 gm/sqi compression was 0.126 g/cm$^3$. Strike-through was 1.7 seconds. Surface wetness 1 was 0.28 grams; surface wetness 2 was 2.7 grams.

Precursor 527-04B, mechanically compressed, because of the greatly reduced calipers and high tensile strength could be wound into tight rolls of long yardage. Thus the problems of shipping and converting are solved. However the strike-through value and the surface wetness 1 value has been somewhat increased and the surface wetness 2 value has been increased by more than an order of magnitude. Thus this mechanically compressed example no longer has the attractive dryness properties seen in Control 527-04 itself.

Topsheets 527-04BA, 527-04BB, 527-04BC, 527-04BD, and 527-04BE. Products of this invention were made by bulking samples of mechanically compressed 527-04 via exposure to air heated to an elevated temperature for 15 seconds in a circulating air oven. Bulked product 527-04BA yielded a caliper, measured under compression of 107 gm/sqi, of 12 mil after 15 second exposure to air heated to 50° C. Bulked product 527-04BB yielded a caliper, measured under compression of 107 gm/sqi, of 18 mil after 15 second exposure to air heated to 75° C. Bulked product 527-04BC yielded a caliper, measured under compression of 107 gm/sqi, of 26 mil after 15 second exposure to air heated to 100° C. Bulked product 527-04BD yielded a caliper, measured under compression of 107 gm/sqi, of 34 mil after 15 second exposure to air heated to 125° C. Bulked product 527-04BE yielded a caliper, measured under compression of 107 gm/sqi, of 37 mil after 15 second exposure to air heated to 150° C.

The bulked Topsheet 527-04BE, a product of this invention, was further characterized. It showed a MD strip tensile strength of 1219 grams per inch and a CD strip tensile strength of 366 grams per inch. its caliper under compression was, at 19 gm/sqi, 81 mils, a second test at 107 gm/sqi, 39 mils, and at 131 gm/sqi, 42 mils. Density under 107 gm/sqi compression was 0.033 gm/cm$^3$. Strike-through was 0.8 seconds. Surface wetness 1 was 0.14 grams; surface wetness 2 was 0.26 grams. The topside softness rating was 70; bottomside softness was 68.

Bulking of 527-04B to yield 527-04BE, a product of this invention, has regenerated the attractive combination of strike-through properties and surface wetness first seen in 527-04. Products of our invention, formed from bicomponent fibers in a lofty state, transformed into the compressed state via winding into a tight roll, then rebulked via heat exposure to a thick topsheet showing superior strike-through and surface wetness properties, is clearly a significant advance in the art of diaper topsheet constructions.

EXAMPLE 11

Control 551-02. A two layered web assembly was made by depositing 3 denier flat-crimped polyethylene/polyester sheath/core bicomponent fiber from two cards onto a moving belt. The two layered assembly was supported on a rotating bonding drum having 35% open area such that air heated to 130° C. was blown through the assembly for an exposure time of approximately 9 seconds. The web was compressed together by the air velocity moving through the web into the patterned open areas of the bonding drum. No hold-down wire was used.

The resulting composite nonwoven fabric, showing a basis weight of 28 gm/sqy, had these properties: The fabric had a MD strip tensile strength of 1637 grams per inch and a CD strip tensile strength of 419 grams per inch. Its caliper under compression was at 19 gm/sqi, 66 mils, at 107 gm/sqi, 39 mils, and, at 131 gm/sqi, 39 mils. Density under 107 gm/sqi compression was 0.034 gm/cm$^3$. Strike-through was 1.0 seconds. Surface wetness 1 was 0.13 grams; surface wetness 2 was 0.15 grams. Surface softness results of 110 and 85 were observed for the topside and bottomside of the web respectively.

The rapid strike-through coupled with the low surface wetness 1 and 2 values make Control 551-02 a very attractive diaper topsheet candidate. However the high loft, responsible for the attractive strike-through and surface wetness 1 and 2 values, make rolls of this product very bulky and thus expensive to ship and convert on the diaper machine.

Precursor 551-02A. The bulky nonwoven fabric described in Control 551-02 was wound in a tight compact roll. After several days to simulate aging during shipping, webs corresponding to 1 inch depth into the roll were removed for evaluation to yield Precursor 551-02A.

The mechanically compressed Precursor 551-02A, showing a basis weight of 26 gm/sqy, had these properties: The fabric had a MD strip tensile strength of 1682 grams per inch and a CD strip tensile strength of 368 grams per inch. Its caliper under compression was, at 19 gm/sqi, 35 mils, at 107 gm/sqi, 18 mils, and at 131 gm/sqi, 20 mils. Strike-through was 2.0 seconds. Surface wetness 1 was 0.12 grams; surface wetness 2 was 1.0 grams. Density under 107 gm/sqi compression was 0.068 gm/cm$^3$. Surface softness results of 85 were observed for both the top and bottom side of the web.

Precursor 551-02A, because of the greatly reduced calipers and high tensile strength could be wound into tight rolls of long yardage. Thus the problems of shipping and converting are solved. However the strike-through value has been doubled and the surface wetness 2 value has increased by nearly an order of magnitude. Thus the mechanically compressed Precursor 551-02A no longer has as attractive dryness properties as seen in Control 551-02.

Topsheets 551-02AA, 551-02AB, 551-02AC, 551-02AD, and 551-02AE. Products of this invention were made by bulking samples of 551-02A via exposure to air heated to an elevated temperature for 15 seconds in a circulating air oven. Bulked product 551-02AA yielded a caliper, measured under compression of 107 gm/sqi, of 20 mil after 15 second exposure to air heated to 75° C. Bulked product 551-02AB yielded a caliper, measured under compression of 107 gm/sqi, of 31 mil after 15 second exposure to air heated to 110° C. Bulked product 551-02AC yielded a caliper, measured under compression of 107 gm/sqi of 38 mil after 15 second exposure to air heated to 135° C. Bulked product 551-02AD yielded a caliper, measured under compression of 107 gm/sqi, of 34 mil after 15 second exposure to air heated to 165° C.

The Example 551-02AE, bulked at 150° C., a product of this invention, was also characterized. It showed a MD strip tensile strength of 1293 grams per inch and a CD strip tensile strength of 272 grams per inch. Its caliper under compression was, at 19 gm/sqi, 64 mils, at 107 gm/sqi, 33 mils, and at 131 gm/sqi, 28 mils. Strike-through was 0.8 seconds. Surface wetness 1 was 0.12 grams; surface wetness 2 was 0.19 grams. Density under 107 gm/sqi compression was 0.037 gm/cm$^3$. Surface softness results of 108 and 95 were observed for the top and bottom side of the web respectively.

Bulking of Precursor 551-02A to yield 551-02AE, a product of this invention, has regenerated the attractive combination of strike-through properties and surface wetness first seen in 551-02. Products of our invention, formed from bicomponent fibers in a lofty state, transformed into the compressed state via winding into a tight roll, then rebulked via heat exposure to a thick topsheet showing superior strike-through and surface wetness properties, is clearly a significant advance in the art of diaper topsheet constructions.

Precursor 551-02B. The bulky nonwoven fabric described in Control 551-02 was wound in a tight compact roll. After several days to simulate aging during shipping webs, webs corresponding to 4 inch depth into the roll were removed for evaluation to yield Precursor 551-02B.

The mechanically compressed Precursor 551-02B, showing a basis weight of 27 gm/sqy, had these properties: The fabric had a MD strip tensile strength of 1634 grams per inch and a CD strip tensile strength of 388 grams per inch. Its caliper under compression was, at 19 gm/sqi, 31 mils, at 107 gm/sqi, 15 mils, and at 131 gm/sqi, 15 mils. Density under 107 gm/sqi compression was 0.085 gm/cm$^3$. Strike-through was 1.5 seconds. Surface wetness 1 was 0.12 grams; surface wetness 2 was 1.1 grams. Surface softness results of 92 and 90 were observed for the topside and the bottomside of the roll respectively.

Precursor 551-02B, because of the greatly reduced calipers and high tensile strength could be wound into tight rolls of long yardage. Thus the problems of shipping and converting are solved. However the strike-through value has been somewhat increased and the surface wetness 2 value has increased by nearly an order of magnitude. Thus the mechanically compressed Precursor 551-02B no longer has as attractive dryness properties as seen in Control 551-02.

Topsheets 551-02BA, 551-02BB, 551-02BC, 551-02BD, and 551-02BE. Products of this invention were made by bulking samples of 551-02B via exposure to air heated to an elevated temperature for 15 seconds in a circulating air oven. Bulked product 551-02BA yielded a caliper, measured under compression of 107 gm/sqi, of 19 mil after 15 second exposure to air heated to 75° C. Bulked product 551-02BB yielded a caliper, measured under compression of 107 gm/sqi, of 29 mil after 15 second exposure to air heated to 110° C. Bulked product 551-02BC yielded a caliper, measured under compression of 107 gm/sqi of 42 mil after 15 second exposure to air heated to 135° C. Bulked product 551-02BD yielded a caliper, measured under compression of 107 gm/sqi, of 39 mil after 15 second exposure to air heated to 165° C.

The Example 551-02BE, bulked at 150° C., a product of this invention, was also characterized. It showed a MD strip tensile strength of 1468 grams per inch and a CD strip tensile strength of 364 grams per inch. Its caliper under compression was, at 19 gm/sqi, 68 mils, at 107 gm/sqi, 31 mils, and at 131 gm/sqi, 33 mils. Density under 107 gm/sqi compression was 0.041 gm/cm$^3$. Strike-through was 1.0 seconds. Surface wetness 1 was 0.12 grams; surface wetness 2 was 0.7 grams. The topside softness rating was 78; bottomside softness was 72.

Bulking of Example 551-02B to yield 551-02BE, a product of this invention has nearly regenerated the attractive combination of strike-through properties and surface wetness first seen in 551-02. Products of our invention, formed from bicomponent fibers in a lofty state, transformed into the compressed state via winding into a tight roll, then rebulked via heat exposure to a thick topsheet showing superior strike-through and surface wetness properties, is clearly a significant advance in the art of diaper topsheet construction.

From the above description and specific Examples of the invention, many variations in the webs, composites, useful products, and processes of this invention will be apparent to those skilled in the relevant arts. Such variations are within the scope of the present invention as measured by the appended claims.

What is claimed is:

1. A process for making bulky nonwoven fabric suitable for use as coverstock or spacer fabric that comprises the steps of:

(a) forming an initial web of one or more layers comprised of thermoplastic bicomponent fibers,, (b) bonding said web by means of a thru-air system, (c) compressing the resulting bonded web to increase its density, (d) transporting and/or otherwise manipulating the compressed web, and (e) subsequently transforming said compressed web, by means of exposure to heat, into low density nonwoven fabric.

2. The process according to claim 1 wherein the thermoplastic bicomponent fibers are selected from the group consisting of sheath/core fibers of the following resin combinations: polyethylene/polypropylene, polyethylene/polyester, polypropylene/polyester, and copolyester/polyester.

3. The process according to claim 1 wherein said initial web contains up to 50% by weight single component matrix fibers.

4. The process according to claim 1 wherein the initial web of one or more layers is formed by carding.

5. The process according to claim 1 wherein thru-air bonding is carried out using bonding surfaces such as wires or drums that have approximately 25–60 percent open area.

6. The process according to claim 5 wherein the thru-air bonding surface has 30–40% open area and no hold-down wire is used.

7. The process according to claim 1 wherein the compressed web is still at or near the bonding temperature as it exits the thru-air bonding oven.

8. The process according to claim 7 wherein compression of the thru-air bonded web is achieved in a nip as the web exits the thru-air bonding oven.

9. The process according to claim 8 wherein the compressed web is exposed to sufficient heat to transform it into a bulky nonwoven fabric with density of 70% or less of that measured for the fabric in the compressed state.

10. The process according to claim 1 wherein compression of the thru-air bonded web is achieved by winding into a tight roll at room temperature at sufficient tension to substantially increase the nonwoven fabric density.

11. The process of claim 10 wherein the compressed web is exposed to sufficient heat to transform it into a bulky nonwoven with density of 70% or less of that measured for the fabric in the compressed state.

12. The process according to claim 1 wherein the web density is increased by at least about 50% relative to its density directly after thru-air bonding. l

* * * * *